US005641617A

United States Patent [19]

Nishio

[11] Patent Number: 5,641,617

[45] Date of Patent: Jun. 24, 1997

[54] PHOTOGRAPHIC MATERIAL FOR LASER SCAN EXPOSURE

[75] Inventor: Takeshi Nishio, Kanagawa, Japan

[73] Assignee: Fuji Photo Film Co., Ltd., Kanagawa, Japan

[21] Appl. No.: 501,792

[22] Filed: Jul. 13, 1995

[30] Foreign Application Priority Data

Jul. 14, 1994 [JP] Japan ..... 6-161894

[51] Int. Cl.[6] ..... G03C 1/83; G03C 1/91

[52] U.S. Cl. ..... 430/522; 430/510; 430/523; 430/944

[58] Field of Search ..... 430/522, 523, 430/944, 510

[56] References Cited

U.S. PATENT DOCUMENTS

| | | | |
|---|---|---|---|
| 3,653,905 | 4/1972 | Depoorter et al. | 430/522 |
| 4,882,265 | 11/1989 | Laganis et al. | 430/522 |
| 5,162,195 | 11/1992 | Inagaki | 430/522 |
| 5,310,630 | 5/1994 | Inagaki | 430/522 |
| 5,322,768 | 6/1994 | Delprato et al. | 430/522 |

FOREIGN PATENT DOCUMENTS

| | | | |
|---|---|---|---|
| 6-10735 | 2/1994 | Japan | G03C 1/76 |

*Primary Examiner*—Lee C. Wright

*Attorney, Agent, or Firm*—Sughrue, Mion, Zinn, Macpeak & Seas

[57] ABSTRACT

There is provided a laser interference fringe-free photographic material which comprises a support and a near infrared-sensitive emulsion layer provided on one side of said support, wherein said emulsion layer has an absorbance of not more than 0.5 at a wavelength of near infrared laser used for exposure, and the total of the photographic material present on said emulsion layer side of said support has an absorbance of not less than 1.0 at the wavelength of the laser used for exposure.

3 Claims, No Drawings

PHOTOGRAPHIC MATERIAL FOR LASER SCAN EXPOSURE

FIELD OF THE INVENTION

The present invention relates to a photographic material and, more particularly, to a photographic material suitable for scanning exposure to a near infrared laser.

BACKGROUND OF THE INVENTION

Hitherto, the method of performing the exposure of a photographic material by scanning laser beams thereon has been adopted as a means for transferring image information from MRI, X-ray CT or the like. As for the light source, semiconductor laser diodes endowed with high power and high stability have recently come into universal use, thereby allowing some latitude in the sensitivity of a photographic material as the output medium. On the other hand, a low coverage rate of silver is required of such a photographic material from the standpoint of rapid processing and environmental preservation. Therefore, there has been proceeding a movement to reduce the size of emulsion grains within the range of sensitivity allowed for maintaining the desired maximum optical density (Dmax).

However, when the sensitive material which is reduced in grain size and coverage rate of silver undergoes a laser scanning exposure, interference fringe bursts upon the eye, which results from the reflection of laser beams inside the photosensitive material. This interference fringe is called "non-contact interference fringe" in JP-B-06-10735 (the term "JP-B" as used herein means an "examined Japanese patent publication") and mentioned in detail therein. The patent publication cited above describes in the claim 1 three methods which enable complete dissolution of the interference fringe. However, it turned out that the backing layer (the method (2) described in the claim 1 of the above-cited reference), which is provided on the support surface situated on the side opposite to the photosensitive emulsions and defined as the near infrared absorption layer, had no function as the so-called absorption layer. Further, every working example of the above-cited reference has no description of effects to be produced by the subbing layer (the method (3) described in the claim 1 of the above-cited reference) defined as a near infrared absorption layer. Moreover, the subbing layer is arranged between the support and the photosensitive emulsion layer.

Actually, it was rather difficult to provide an absorption layer, that is, a dye layer on the same side of the support as the photosensitive emulsion layers. This is because it is necessary to design the absorption layer so that the dye incorporated therein may not substantially diffuse into other layers. Unless diffusion of the dye is prevented, not only the dye will exert harmful spectral effects upon other layers but also effects of the dye layer itself will be marred. However, in so far as the dye-added layer and another hydrophilic colloid layer are brought into contact with each other in a wet condition, it frequently happens that part of the dye added diffuses into the other hydrophilic colloid layers. Therefore, considerable efforts have so far been made to prevent the diffusion of dyes.

For instance, U.S. Pat. Nos. 2,548,564, 4,124,368, and 3,625,694 disclose the method of localizing dye molecules of the type which become anions by dissociation to a particular layer by making them be present together with a hydrophilic polymer mordant having the charge opposite in polarity to that of the dissociated dye molecules.

Also, the method of dyeing a particular layer with dye-adsorbed fine grains of metal salt is disclosed, e.g., in U.S. Pat. Nos. 2,719,088, 2,496,841 and 2,496,843, and JP-A-60-45237.

In addition, the method of dyeing a particular layer with a water-insoluble solid dye is disclosed, e.g., in JP-A-55-120030, JP-A-56-12639, JP-A-55-155350, JP-A-55-155351, JP-A-63-27838, JP-A-63-197943, JP-A-52-192716, European Patents 0 015 601, 0 323 729, 0 274 723, 0 276 566 and 0 299 435, World Patent 88/04794, JP-A-03-223747 and JP-A-04-352151.

However, with all the improved methods cited above, the problem of diffusion of dyes into layers other than the layer to which the dyes are to be fixed cannot yet be solved satisfactorily. Thus, coating a dye layer on the same side of a support as photosensitive emulsion layers is still a problem to solve. On the other hand, even if the coverage rate of silver or the size of emulsion grains are increased, suitability for rapid processing or desired Dmax cannot be attained. Accordingly, the acquisition of high suitability for rapid processing or the achievement of high Dmax, as things stand now, is incompatible with the dissolution of interference fringe.

SUMMARY OF THE INVENTION

An object of the present invention in the complete dissolution of laser interference fringe which is generated in a photographic material which improved the rapid processing suitability and which maintains the required Dmax.

The above-described object is attained with a photographic material which comprises a near infrared-sensitive emulsion layer on one side of a support, with the emulsion layer showing an absorbance of not more than 0.5 at wavelengths of near infrared laser used for exposure, and with the material showing on the emulsion layer side of the support a total absorbance of not less than 1.0 at the wavelength of the near infrared laser used for exposure.

DETAILED DESCRIPTION OF THE INVENTION

The value of absorbance, as hereinafter described in Example 1, is determined under a condition that a certain space is left between a photographic material and a light receiving unit in order to exclude the light scattered by emulsion grains which is supposed to make no contribution to the interference fringe. The absorbance determined under the foregoing condition is lessened by reducing the silver coverage rate and the emulsion grain size of a photographic material. The reduction in emulsion grain size results in an increase in covering power, namely the maximum optical density (Dmax), of the photographic material, while the reduction in silver coverage rate results in enhancement of processability (mainly fixability). Accordingly, the value of absorbance can be regarded as an indication of such properties.

On the other hand, JP-B-06-10735 describes such that the interference fringe is supposed to generate as a result of the reflection of exposure light rays from the two planes formed at the interface between a film element and its surrounding air (at page 139, line 49 on the left side). However, we have proved experimentally that at least the laser beams transmitted by a support were hardly contributory to the formation of interference fringe, and further have revealed that the light reflected by the lower side of a support made an important contribution to the formation of interference fringe.

In this respect, it can also be considered that the absorbance determined in the foregoing manner serves as a good indication of the prediction of the interference fringe generation. This is because such a value reflects the intensity of reflected light from a support. As a result of our experiments, it has been found that the photographic material which has undergone an improvement in processability as it maintains the desired Dmax generates the interference fringe when the absorbance of its photosensitive emulsion layer is not greater than 0.5.

As a measure to dissolve the interference fringe while retaining the foregoing two properties, there has been thought the method of increasing the absorbance by providing a layer for the absorption of laser beams in some position on the photosensitive emulsion layer side of a photosensitive layer. By adopting this method, it has been found that complete dissolution of the interference fringe became possible when the absorbance was increased up to at least 1.0.

As for the absorbance, the value ranging from 1.0 to 5.0 is desirable. From the standpoint of the sensitivity, however, it is preferable for the absorbance to be in the range of 1.0 to 3.0, especially 1.0 to 2.0.

With respect to the light source of laser beams, semiconductor laser diodes which are available at a low price are advantageously used. It is desirable that the laser beams emitted from such diodes have wavelengths of not shorter than 700 nm.

As a material which can absorb the foregoing laser beams, it is advantageous to use the dyes represented by the following formula (I) in the form of fine solid dispersion:

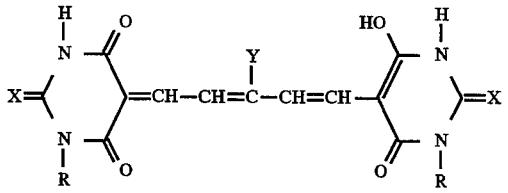

(I)

wherein R represents an unsubstituted or monosubstituted aryl group, X represents an oxygen atom or a sulfur atom and Y represents an alkyl group having 1 to 4 carbon atoms, provided that neither R nor Y contains a group having an ionizable proton or a salt thereof.

The compounds of formula (I) are described below in detail.

The aryl group represented by R includes an aryl group containing 6 to 10 carbon atoms (e.g., preferably phenyl and naphthyl groups, more preferably a phenyl group). As for the substituent which these aryl groups may have, there can be cited as examples a halogen atom (such as F, Cl, Br), a cyano group, a nitro group, an alkyl group containing 1 to 8 carbon atoms (such as methyl, ethyl, propyl, iso-propyl, sec-butyl, n-butyl, t-butyl, hexyl), an amino group containing 0 to 6 carbon atoms (such as unsubstituted amino, dimethylamino, diethylamino), an alkoxy group containing 1 to 8 carbon atoms (such as methoxy, ethoxy, butoxy), an aryloxy group containing 6 to 10 carbon atoms (such as phenoxy, p-methylphenoxy), an aryl group containing 6 to 10 carbon atoms (such as phenyl, 2-chlorophenyl), an ester group containing 2 to 8 carbon atoms (such as methoxycarbonyl, ethoxycarbonyl), a carbamoyl group containing 1 to 8 carbon atoms (such as unsubstituted carbamoyl, methylcarbamoyl, ethylcarbamoyl) and an acylamino group containing 2 to 8 carbon atoms (such as acetylamino, propionylamino).

While X represents an oxygen atom or a sulfur atom, an oxygen atom is preferred as X.

Y is an alkyl group containing 1 to 4 carbon atoms (e.g., methyl, ethyl).

The compounds of formula (I) are used in the form of dispersion in an appropriate solvent (e.g., water, methyl alcohol or the like). More preferably, the dispersion is further mixed with hydrophilic colloid. As for the hydrophilic colloid, any of known hydrophilic colloids can be used, but gelatin as the representative thereof is advantageously used.

Specific examples of the compounds represented by formula (I) are illustrated below.

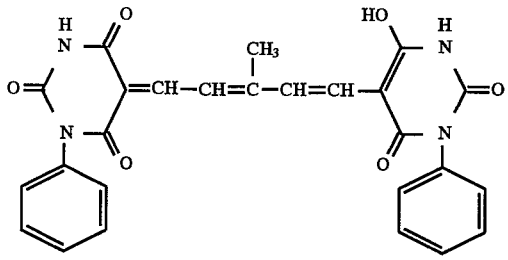

I-1

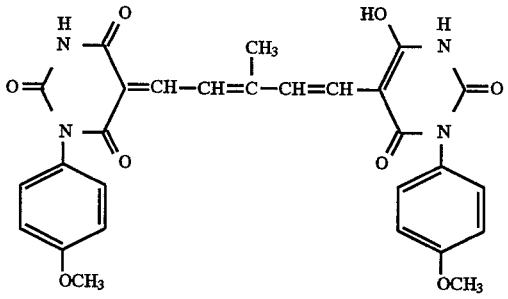

I-2

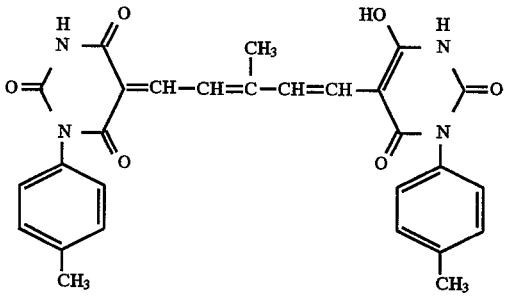

I-3

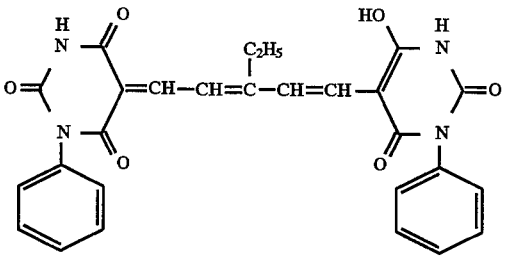

I-4

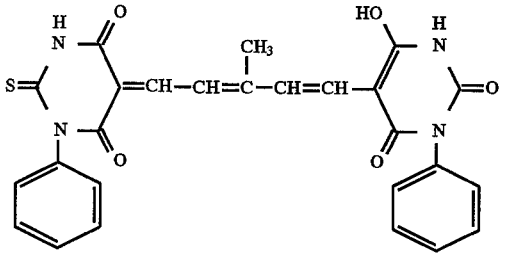

I-5

According to the methods known to those skilled in the art (e.g., the condensation reaction between the corresponding barbituric acid compounds and pentamethine sources), the compounds of formula (I) can be synthesized with ease and at a low price. More specifically, they can be prepared in accordance with the synthesis examples described in British Patent 1,133,986, U.S. Pat. Nos. 3,247,127, 4,042,397, etc., and Example 1 of Japanese Patent Application No. 05-251779.

In dispersing the dyes of the present invention, there can be used a dispersing machine chosen arbitrarily from among a ball mill, a sand mill, a colloid mill, a vibration ball mill, a planetary ball mill, a jet mill, a roll mill, MANTON GAULIN, a micro fluidizer, a disk impeller mill and the like, as described in JP-A-52-92716 and WO 88/04794. However, it is preferable to use a vertical or horizontal type medium dispersing machine.

In any case, it is desirable to use a solvent (e.g., water), and more desirable to additionally use a surfactant suitable for dispersion. As the surfactant, it is possible to use an anionic surfactant as described in JP-A-52-92716 and WO 88/04794, and an anionic polymer as described in JP-A-04-324858. Although a nonionic or cationic surfactant can also be used, it is advantageous to use an anionic polymer or an anionic surfactant.

Also, the present dyes for use in the present invention may be separated out as fine crystals by dissolving them in an appropriate solvent and then adding thereto a poor solvent. Therein, the foregoing surfactant for dispersion use may be used. On the other hand, the dyes may be first dissolved in a solvent by controlling the pH in the solvent, and then deposited as fine crystals by changing the pH.

The average grain size of the present dyes in a dispersing medium is in the range of 0.005 to 10 μm, preferably 0.01 to 1 μm, and more preferably 0.01 to 0.5 μm. Further, it may range from 0.01 to 0.1 μm, if needed. In addition, it is preferable for the fine grains of the present dyes to have a monodisperse size distribution.

In dispersing the dyes of general formula (I), the dyes solids need not undergo any pretreatment, but they may be dispersed as they are. That is, the dye solids in a wet condition which are obtained in the course of synthesis are preferably used for preparing the dispersion.

Further, they may undergo a heating treatment before and/or after the dispersing operation. In order to perform the heating treatment effectively, it is advantageous to carry out the heating treatment at least after the dispersing operation.

The present dyes have no particular restriction as to the way of heating, in so far as heat can be applied to the dye solids. The suitable heating temperature is not lower than 40° C., while any temperature may be the upper limit thereof as far as it is lower than the decomposition point of the dye used. It is preferably for the upper limit of heating temperature to be 250° C. More preferably, the heating temperature ranges from 50° C. to 150° C.

In so far as the dyes are not decomposed, they have no particular limitation on the heating time. In general, the heating time is in the range of 15 minutes to one week, preferably from 1 hour to 4 days.

In order to accomplish the heating treatment effectively, it is desirable that the dye solids undergo the heat treatment in a solvent. Any solvent can be used therein unless it dissolves the dyes of formula (I) in a substantial sense. Examples of such a solvent include water, alcohols (such as methanol, ethanol, isopropyl alcohol, butanol, isoamyl alcohol, octanol, ethylene glycol, diethylene glycol, ethyl cellosolve, etc.), ketones (such as acetone, methyl ethyl ketone, etc.), esters (such as ethyl acetate, butyl acetate, etc.), alkylcarboxylic acids (such as acetic acid, propionic acid, etc.), nitriles (such as acetonitrile, etc.) and ethers (such as dimethoxyethane, dioxane, tetrahydrofuran, etc.).

The object of the invention can be effectively attained by carrying out the heating treatment in the presence of an organic carboxylic acid. As for the organic carboxylic acid usable for the above purpose, an alkylcarboxylic acid (e.g., acetic acid, propionic acid), carboxymethyl celluloses (e.g., CMC), and an arylcarboxylic acid (e.g., benzoic acid, salicylic acid) are examples thereof.

When such an organic carboxylic acid is used as a solvent, the amount thereof may be 0.5 to 100 times by weight that of the dye of formula (I). When a solvent other than organic carboxylic acids is used and an organic carboxylic acid is added thereto, on the other hand, the organic carboxylic acid can be used in a proportion of 0.05 to 100% by weight to the dye of formula (I).

The dyes represented by formula (I) may be used in any amount if a desired effect can be produced thereby. Although proper amounts differ among different dyes, they are preferably in the range of 5 mg/m$^2$ to 1,000 mg/m$^2$, and more preferably in the range of 10 mg/m$^2$ to 500 mg/m$^2$. The addition may be carried out at any stage before the coating operation.

The dyes represented by formula (I) may be used in any of the constituent layers, including emulsion layers and other hydrophilic colloid layers (e.g., an interlayer, a protective layer, an antihalation layer, a filter layer, a backing layer), and it is preferable for the dyes to be present on the photosensitive emulsion layer side of a support. In view of the sensitivity, it is desirable that the dyes be located between the support and a photosensitive emulsion. Of course, the dyes may be incorporated in only one constituent layer, or in two or more of constituent layers.

As for the hydrophilic colloid which can be used in such layers, gelatin is a representative material, but any of other hydrophilic colloids known to be usable in photography can also be used. A suitable gelatin coverage of the dye layer is in the range of 0.1 g/m$^2$ to 5 g/m$^2$, preferably 0.1 g/m$^2$ to 3 g/m$^2$.

The silver halide grains used in the present invention are those having a regular crystal form such as that of a cube or an octahedron, an irregular crystal form such as that of a sphere or a plate or so on, or a composite form thereof. Also, a mixture of various crystal forms of silver halide grains may be used. However, it is preferable to use silver halide grains having a regular crystal form.

The size of silver halide grains used in the present invention is not greater than 0.4 μm, preferably not more than 0.28 μm, and more preferably not more than 0.2 μm.

As small-size silver halide grains can ensure high covering power, they have an advantage in reducing a silver/binder ratio.

The size distribution of silver halide grains may be narrow or broad. However, the so-called monodisperse emulsion is preferable in view of photographic properties, including latent image stability and pressure resistance, and further processing stability, including the developer pH dependence thereon. If the size distribution is expressed in terms of the quotient of the standard deviation S of distribution of the diameters of circles, the circles being determined so as to have the same areas as the projected areas of silver halide grains, divided by the average diameter d of the circles, namely S/d, it is desirable that the value of S/d be not greater than 20%, particularly not greater than 15%.

The silver halide photographic emulsions used in the present invention are chemically sensitized with a gold compound (gold sensitization) in order to achieve high sensitivity and low fog density. In general, the gold sensitization is effected by adding a gold sensitizer to a silver halide photographic emulsion and agitating the resulting emulsion at a high temperature, desirably 40° C. or higher, for some definite time.

The oxidation number of gold which constitutes the foregoing gold sensitizer may be +1 or +3, and so any of gold compounds generally used as gold sensitizer may be employed. Typical examples of such a gold sensitizer include chloroaurates such as potassium chloroaurate, etc., auric trichloride, potassium auric thiocyanate, potassium iodoaurate, tetracyanoauric acid, ammonium aurothiocyanate, pyridyltrichlorogold, and so on.

The amount of a gold sensitizer added differs depending on conditions, but as a guide thereto it is suitable to be in the range of $1\times10^{-7}$ to $5\times10^{-4}$ mole per mole of silver halide.

The emulsions applied to the present invention may be chemically sensitized by adopting sulfur or selenium sensitization, reduction sensitization, precious metal sensitization and so on individually or as a combination thereof. More specifically, sulfur sensitization using active gelatin or a compound containing sulfur capable of reacting with silver ion (e.g., thiosulfates, thiourea compounds, mercapto compounds, rhodanine compounds), reduction sensitization using a reducing material (e.g., stannous salts, amines, hydrazine derivatives, formamidine sulfinic acid, silane compounds) and precious metal sensitization using a precious metal compound (e.g., the above-cited gold complexes, salts or complexes of Group VIII metals such as those of platinum, iridium, palladium, rhodium, iron, etc.) may be employed individually or as a combination thereof. For the emulsions used in the present invention, it is preferable to undergo the combination of sulfur or selenium sensitization with the foregoing gold sensitization. In view of the control of sensitivity and gradation, it is preferable for such chemical sensitization to be carried out in the presence of a hydroxyazaindene compound or a nucleic acid.

With respect to sensitizing dyes suitable for the emulsions used in the present invention, the sensitizing dyes disclosed, e.g., in JP-A-60-40939, JP-A-03-11336, JP-A-04-324855, JP-A-05-45833, JP-A-05-80451 and JP-A-05-127334 may be used to advantage. In particular, there are preferred the compounds represented by formula (II) in JP-A-04-324855, with specific examples illustrated at pages 397-399 of the said gazette.

Those sensitizing dyes may be used alone or in combination. Combinations of sensitizing dyes are often employed for the purpose of supersensitization. Materials which can exhibit a supersensitizing effect in combination with a certain sensitizing dye although they themselves do not spectrally sensitize silver halide emulsions or do not absorb light in the visible region may be incorporated into the silver halide emulsions.

For instance, the compounds represented by formula (IV) in JP-A-04-324855 are preferred as supersensitizing material.

Useful sensitizing dyes, supersensitizing combinations of dyes and materials capable of exhibiting a supersensitizing effect are described, e.g., in *Research Disclosure*, Vol. 176, No. 17643, p. 23, item IV-J (December 1978), or the above-cited JP-B-49-25500, JP-B-43-4933, JP-A-59-19032 and JP-A-59-192242.

As for the amount of sensitizing dyes used for emulsions in the present invention, it is desirable that the optimum thereof be chosen depending upon the grain size and the halogen composition of the silver halide emulsions, the chemical sensitization method adopted and the extent to be achieved thereby, the relation between the layer in which the sensitizing dyes are incorporated and the silver halide emulsions, the species of antifoggants used, and so on. The testing methods for the choice of optimum are well known to those skilled in the art. In general, the optimal amount of sensitizing dyes used is in the range of $10^{-7}$ to $1\times10^{-2}$ mole, particularly $10^{-6}$ to $5\times10^{-3}$ mole, per mole of silver halide.

The photosensitive emulsions used in the present invention are referred to as emulsions which are spectrally sensitized by sensitizing dyes at the wavelengths of a laser light source used, and the photosensitive emulsion layer of the present invention is referred to as a layer containing such emulsions.

The photographic materials prepared in accordance with embodiments of the present invention may contain water-soluble dyes in their hydrophilic colloid layers as filter dyes or for other various purposes, including the prevention of irradiation. Examples of such dyes include oxonol dyes, hemioxonol dyes, styryl dyes, merocyanine dyes, cyanine dyes and azo dyes. Of these dyes, oxonol dyes, hemioxonol dyes and merocyanine dyes are useful in particular.

As a support of the present photographic material, a transparent support is preferably used.

A suitable material thereof is a polyethylene terephthalate film. In particular, it is preferable for the terephthalate film to be colored in a blue tint. However, blue coloration is not always required of the support material.

For improving the adhesiveness of the support to hydrophilic colloid layers, it is desirable that the support surface be subjected to a corona discharge treatment, a glow discharge treatment or an ultraviolet irradiation treatment.

Further, an undercoat layer constituted of a styrenebutadiene latex, a vinylidene chloride latex or the like may be provided on the support, and further a gelatin layer may be formed on the upper side of the undercoat layer.

On the other hand, an undercoat layer may be formed by applying to the support an organic solvent containing a polyethylene swelling agent and gelatin.

Also, these undercoat layers can heighten their adhesiveness to hydrophilic colloid layers by undergoing a surface treatment.

It is desirable in the present invention that the total coverage rate of gelatin on the silver halide emulsion layer side of a support be not more than 6 g/m$^2$, preferably not more than 5 g/m$^2$, and particularly preferably not more than 4.5 g/m$^2$.

To the photosensitive emulsion of the present invention, it is appropriate to have a silver coverage rate of not more than 2.6 g/m$^2$, preferably not more than 2.3 g/m$^2$, and more preferably not more than 2.0 g/m$^2$.

Further, the silver/gelatin ratio by weight in the silver halide emulsion layer is an important factor from the standpoint of rapid processing suitability. When the silver/gelatin ratio in the silver halide emulsion layer is increased, there happens so-called emulsion-picked-off phenomenon, or the phenomenon such that part of the silver halide photographic material is peeling off with projections from the rollers during the processing with an automatic developing machine, and so it becomes difficult to form a clear image. In this respect, it is desirable that the silver/gelatin ratio in the silver halide emulsion layer be not greater than 1.8 by weight, preferably not greater than 1.4 by weight, and more preferably not greater than 1.2 by weight.

Various additives as described, e.g., in the following patent gazettes can also be used for the photographic material of the present invention.

| Item | Patent Gazettes |
|---|---|
| 1) Chemical sensitizers | JP-A-02-68539, page 10, line 13 on the right upper column to line 16 on the left upper column, and Japanese Patent Application No. 3-105035. |
| 2) Antifoggant, and Stabilizers | JP-A-02-68539, page 10, line 17 on the left lower column, to page 11, line 7 on the left upper column, and ibid., page 3, line 2 on the left lower column, to page 4, on the left lower column. |
| 3) Tone improving agents | JP-A-62-276539, page 2, line 7 on the left lower column, to page 10, line 20 on the left lower column, and JP-A-03-94249, page 6, line 15 on the left lower column, to page 11, line 19 on the right upper column. |
| 4) Surfactants, and Antistatic agents | JP-A-02-68539, page 11, line 14 on the left upper column, to page 12, line 9 on the left upper column. |
| 5) Matting agents, Lubricants, and Plasticizers | JP-A-02-68539, page 12, line 10 on the left upper column to line 10 on the right upper column, and page 14, line 10 on the left lower column to line 1 on the right lower column. |
| 6) Hydrophilic colloids | JP-A-02-68539, page 12, line 11 on the right upper column to line 16 on the left lower column. |
| 7) Hardeners | JP-A-02-68539, page 12, line 17 on the left lower column, to page 13, line 6 on the right upper column. |
| 8) Polyhydroxybenzenes | JP-A-03-39948, page 11, left upper column, to page 12, left lower column, and EP-A-0452772. |

A backing layer to be provided on the side opposite to the present silver halide emulsion layer is illustrated below.

As for the backing layer, a hydrophilic colloid is preferably applied thereto. The backing layer is constituted of a surface protecting layer and a back layer, and the present compounds may be incorporated into both the constituent layers. In addition to a hydrophilic colloid, the backing layer may contain as additives a coating aid, an antistatic agent, a slippability improving agent, a dye, a matting agent, a surfactant and so on. It is desirable that the back layer have a thickness of 1.5 to 4 μm.

The backing layer in the present invention is a general name of the reverse of a support which is opposite to the photosensitive emulsion layer, and includes the surface protecting layer and the subbing layer provided on the reverse side.

In the processing of photographic materials according to the present invention, materials and methods which are widely known to those skilled in the art can be adopted. For instance, the methods as described in JP-A-02-103037, page 16, line 7 on the right upper column, to page 19, line 15 on the left lower column, JP-A-02-115837, page 3, line 5 on the right lower column, to page 6, line 10 on the right upper column, Japanese Patent Application No. 6-109579 and JP-A-06-051452 can be applied to the processing in the present invention. Also, heat development can be applied to the present photographic material.

The present invention will now be illustrated in more detail by the reference to the following examples.

EXAMPLE 1

1. Preparation of Silver Halide Emulsions A and B:

Fifteen gram of gelatin was added to 900 ml of distilled water, and dissolved therein at 40° C. The pH thereof was adjusted to 3.0 with citric acid, and thereto was added 1.35 g of sodium chloride. To the resulting solution, there were added with stirring a solution containing 85 g silver nitrate in 152.6 ml of distilled water and a solution containing in 160.8 ml of distilled water 30.6 g of sodium chloride and $K_2IrCl_6$ in an amount corresponding to $10^{-6}$ mole per mole of the finished silver halide over a 4-minute period uunder a temperature of 50° C.

One minute 30 seconds later, a solution containing 75 g of silver nitrate in 134.6 ml of distilled water and a solution containing 27 g of sodium chloride in 141.5 ml of distilled water were admixed with the foregoing solution over a 7-minute period under a temperature of 50° C., thereby forming the core part of silver halide grains to be prepared. Subsequently thereto, a solution containing 40 g of silver nitrate in 19.2 ml of distilled water and a solution containing in 122.6 ml of distilled water 11.9 g of sodium chloride, 5.7 g of potassium bromide and $K_4Fe(CN)_6.3H_2O$ in an amount corresponding to $1\times10^{-5}$ mole per mole of the finished silver halide were added with stirring over a 6.5-minute period under a temperature of 50° C., thereby forming the shell part of silver halide grains.

The observation by electron microscopy revealed the thus obtained emulsion to be an emulsion comprising cubic grains having a size of about 0.2 μm, expressed in terms of the average diameter of circles having the areas corresponding to projected areas of individual grains, and a variation coefficient of 10% with respect to the grain size distribution. Another emulsion was prepared in the same manner as described above, except that the temperature upon addition of silver nitrate and halides was changed. The thus prepared emulsion was an emulsion comprising cubic grains having an average grain size of 0.15 μm (variation coefficient: 10%).

After the desalting treatment, these emulsions each were admixed with 102.5 g of gelatin, 100 mg of PROXEL, 1.7 g of phenoxyethanol and 0.15 g of nucleic acid, and adjusted to pH 6.2 and further to pAg 7.7 with sodium chloride. Further, they each were chemically sensitized at 60° C. in the following manner: To each emulsion, 43 mg of sodium thiosulfonate was first added, 8.7 mg of sodium thiosulfate was added after a lapse of 5 minutes and 18.8 mg of chloroauric acid was added after a further lapse of 5 minutes. Then, each emulsion was aged for 60 minutes, and was solidified by quenching as 0.38 g of 4-hydroxy-6-methyl-1,3,3a,7-tetrazaindene was added thereto. Thus, Emulsion A (grain size: 0.2 μm) and Emulsion B (grain size: 0.15 μm) were obtained.

2. Preparation of Photosensitive Emulsions C, D and E:

In accordance with a controlled double jet method, a water solution containing silver nitrate (203 g) and a solution containing potassium bromide and $K_2IrCl_6$ (in an amount corresponding to $1\times10^{-7}$ mole per more of the finished silver halide) were added to 1 liter of water containing 0.06 g of potassium bromide, 41 g of gelatin and 1.2 g of ammonia which were put in a vessel kept at 65° C. over a 54-minute period as the pAg was kept at 7.6. Then, 0.11 g of KI was further added thereto. Thus, a cubic monodisperse silver bromide emulsion having an average grain size of 0.40 μm (variation coefficient: 10%) was obtained. After the desalting treatment, the emulsion obtained was admixed with 71 g of gelatin, 2.9 g of phenoxyethanol and 0.6 g of sodium polystyrenesulfonate as a thickener, and then adjusted to pH 6.2 and pAg 8.1. The resulting emulsion was chemically sensitized with sodium thiosulfate and chloroauric acid as it was kept at 65° C., and further admixed with 0.4 g of 4-hydroxy-6-methyl-1,3,3a,7-tetrazaindene, and then quenched for solidification. Thus, Emulsion C was prepared.

Cubic monodisperse (variation coefficient: 10%) silver bromide emulsions having average grain sizes of 0.28 μm and 0.24 μm respectively were prepared in the same manner as in the preparation of Emulsion C, except that the temperature and the amount of ammonia upon controlled double jet operation were changed by prescribed quantities and further the amount of $K_2IrCl_5$ added was changed to $3\times10^{-7}$ mole per mole of the finished silver halide. These emulsions underwent the same treatments as in the preparation of Emulsion C to prepare Emulsion D and Emulsion E respectively.

3. Preparation of Dye Dispersion:

2.5 g of a dye, 10.3 g of a 4.3% water solution of surfactant (Triton X-200, trade name, a product of Rohm & Hass Co., Ltd.) and 50.5 g of water were previously mixed with stirring, and placed in an EIGER MOTORMILL (M-50, made by EIGER Japan Co., Ltd.) wherein 40 cc of zirconia beads measuring from 0.8 mm to 1.2 mm in diameter were put, followed by dispersing at 5,000 r.p.m. Thus, a dispersion of fine crystalline dye having a grain size of not greater than 1 μm was obtained. A 50 g portion of the thus obtained fine crystalline dye dispersion was mixed with 1.8 g of gelatin and 13.3 g of water at 40° C. with stirring, and subjected to the preparation of photographic materials according to the present invention.

4. Preparation of Coating Solution for Photosensitive Emulsion Layer:

Coating solutions were prepared by adding to Emulsions A, B, C, D and E respectively the following ingredients in their respective amounts set forth below per mole of silver halide. Therein, the gelatin was added in such amounts that Emulsion A and Emulsion B might have the same silver/binder ratio by weight, while proper amounts of gelatin were added to Emulsions C, D and E respectively.

<Composition of Emulsion Solution for Coating>

| | | |
|---|---|---|
| a. | Gelatin | proper amount |
| b. | Spectral sensitizing dye [1] | $7.3\times10^{-5}$ mole |
| c. | Supersensitizer [2] | 0.42 g |
| d. | Polyacrylamide (molecular weight: $4\times10^4$) | 9.2 g |
| e. | Trimethylolpropane | 1.4 g |
| f. | Ethylacrylate/acrylic acid (95/5) copolymer latex | 20 g |
| g. | Compound [3] | 0.38 g |
| h. | Compound [4] | 0.085 g |

Spectral Sensitizing Dye [1]

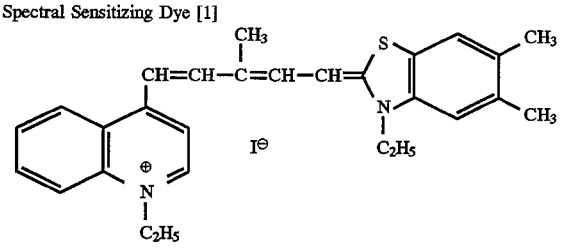

-continued

Supersensitizer [2]

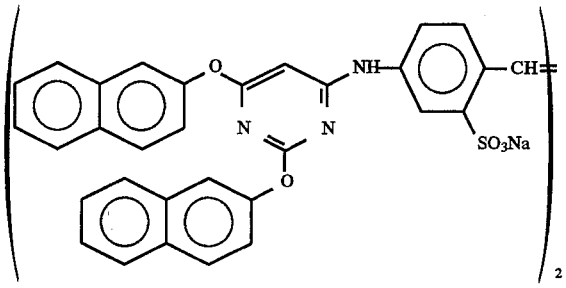

Compound [3]

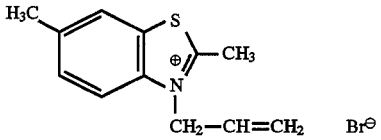

Compound [4]

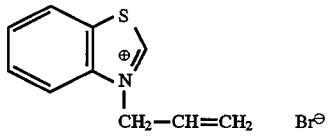

4. Preparation of Coating Solution for Surface Protective Layer:

The ingredients set forth below were placed in a vessel warmed to 40° C. to prepare a coating solution.

| | | |
|---|---|---|
| a. | Gelatin | 100 g |
| b. | Polyacrylamide (molecular weight: $4\times10^4$) | 8.7 g |
| c. | Sodium polystyrenesulfonate (molecular weight: $6.0\times10^5$) | 0.8 g |
| d. | Polymethylmethacrylate fine particles (average size: 2.5 μm) | 2.7 g |
| e. | Sodium polyacrylate | 2.6 g |

-continued

| | | |
|---|---|---|
| f. | Sodium t-octylphenoxyethoxyethanesulfonate | 1.6 g |
| g. | $C_{16}H_{33}O-(CH_2CH_2O)_{10}-H$ | 3.6 g |
| h. | $C_8F_{17}SO_3K$ | 176 mg |
| i. | $C_8F_{17}SO_2N(C_3H_7)(CH_2CH_2O)_4(CH_2)_4-SO_3Na$ | 88 mg |
| j. | NaOH | 0.2 g |
| k. | Methanol | 83 ml |
| l. | 1,2-bis(vinylsulfonylacetamido)ethane | adjusted to such an amount as to be 2.5 wt % to the total amount of gelatin on the emulsion layer side |
| m. | Compound [5] (PROXEL) | 56 mg |

Compound [5]

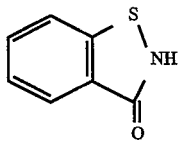

5. Preparation of Coating Solution for Dye layer between Emulsion Layer and Support:

A coating solution was prepared by placing in a vessel warmed to 40° C. the following ingredients in their respective amounts so as to have coverage rates (per $m^2$) set forth below.

| | |
|---|---|
| a. Gelatin | 1.6 g/$m^2$ |
| b. Dye (shown in Table 1) | (coverage set forth in Table 1) |
| c. Sodium polystyrenesulfonate | 20.2 g/$m^2$ |
| d. Sodium t-octylphenoxyethoxyethanesulfonate | 20.4 mg/$m^2$ |

The dye used as Dye b was Dye I-1 of formula (I) which was in a state of finely divided solid dispersion.

6. Preparation of Coating Solution for Backing Layer:

-continued

| | |
|---|---|
| solid dispersion (shown in Table 1) | forth in Table 1 |
| c. Sodium polystyrenesulfonate | 29 mg/$m^2$ |
| d. Phosphoric acid | 9.2 mg/$m^2$ |
| e. Ethylacrylate/acrylic acid (95/5) copolymer latex | 50.6 mg/$m^2$ |
| f. Compound [5] | 42 mg/$m^2$ |

7. Preparation of Coating Solution for Surface Protective Layer of Backing Layer:

A vessel was warmed to 40° C., and therein were placed the ingredients set forth below, thereby preparing a coating solution.

| | |
|---|---|
| a. Gelatin | 100 g |
| b. Sodium polystyrenesulfonate | 0.78 g |
| c. Polymethylmethacrylate fine particles (average particle size: 3.5 μm) | 4.3 g |
| d. Sodium t-octylphenoxyethoxyethanesulfonate | 2 g |
| e. Sodium polyacrylate | 1.8 g |
| f. $C_{16}H_{33}O-(CH_2CH_2O)_{10}-H$ | 4.05 g |
| g. $C_8F_{17}SO_3K$ | 396 mg |
| h. $C_8F_{17}SO_2N(C_3H_7)(CH_2CH_2O)_4(CH_2)_4-SO_3Na$ | 52 mg |
| i. NaOH | 0.24 g |
| j. Methanol | 148 cc |
| k. 1,2-bis(vinylsulfonylacetamido)ethane | adjusted to such an amount as to be 2.2 wt % to the total amount of gelatin on the back side |
| l. Compound [5] | 52.5 mg |

A vessel was warmed to 40° C., and therein were placed the following ingredients in their respective amounts so as to have the coverage rates (per $m^2$) set forth below, thereby preparing a coating solution for a backing layer.

| | |
|---|---|
| a. Gelatin | 2.3 g/$m^2$ |
| b. Dye in a state of finely divided | coverage rate set |

8. Preparation of Photographic Materials:

The above-described coating solution for a backing layer and the above-described coating solution for a surface protective layer of the backing layer were coated on one side of a blue-colored polyethylene terephthalate support at gelatin coverage rates of 2.3 g/$m^2$ (backing layer) and 1.02 g/$m^2$ (surface protective layer), respectively.

Subsequently, on the other side of the support were coated the above-described coating solution for a dye layer between the support and an emulsion layer, the above-described coating solution for the emulsion layer and the above-described coating solution for a surface protective layer so that the dye layer might have a gelatin coverage rate of 1.6 g/m$^2$, the emulsion layer might have a silver coverage rate as set forth in Table 1 and a gelatin coverage rate satisfying the silver/gelatin ratio of 1.15 and the surface protective layer might have a gelatin coverage rate of 1.09 g/m$^2$. In the manner as described above, there were prepared Photographic Materials 1 to 12 as set forth in Table 1.

TABLE 1

| Photographic Material No. | Photosensitive Emulsion Layer | | | Backing Layer | | Dye Layer between Emulsion Layer and Support | |
|---|---|---|---|---|---|---|---|
| | Emulsion No. | Silver Halide Grain Size [μm] | Silver Coverage [g/m$^2$] | Dye Species | Dye Coverage [mg/m$^2$] | Dye Species | Dye Coverage [mg/m$^2$] |
| 1 | B | 0.15 | 2.0 | — | 0 | — | 0 |
| 2 | A | 0.20 | 2.0 | — | 0 | — | 0 |
| 3 | E | 0.24 | 2.0 | — | 0 | — | 0 |
| 4 | D | 0.28 | 2.0 | — | 0 | — | 0 |
| 5 | C | 0.40 | 2.0 | — | 0 | — | 0 |
| 6 | A | 0.20 | 4.8 | — | 0 | — | 0 |
| 7 | A | 0.20 | 6 | — | 0 | — | 0 |
| 8 | A | 0.20 | 2.0 | — | 0 | I - 1 | 5.0 |
| 9 | A | 0.20 | 2.0 | — | 0 | I - 1 | 10 |
| 10 | A | 1.20 | 2.0 | — | 0 | I - 1 | 13 |
| 11 | B | 0.15 | 2.0 | — | 0 | I - 1 | 17 |
| 12 | A | 0.2 | 2.0 | I - 1 | 40 | — | 0 |

9. Observation of Interference Fringe:

The photographic materials prepared above, from No. 1 to No. 12, were each cut into B4-size sheets. Each sheet was uniformly exposed by means of an exposing device-united automatic developing machine which was equipped with 780 nm semiconductor laser as a light source, FL-IMD (trade name, a product of Fiji Photo Film Co., Ltd.), so that the optical density might be about 1.2, and then processed under a condition that Dry to Dry might be 67 seconds. The thus processed sheets were examined as to whether the interference fringe was observed or not. The criterion for the evaluation is as follows:

| Evaluation of Interference Fringe Level | Result of Observation |
|---|---|
| 5 | Interference fringe is very clearly observed. |
| 4 | Interference fringe is clearly observed. |
| 3 | Interference fringe is faintly observed. |
| 2 | Interference fringe is hardly observed, but the presence thereof can be ascertained. |
| 1 | Interference fringe is not observed at all (no problem in a practical sense). |

Additionally, the developer used for the foregoing processing operation was the same as in Example 2 of Japanese Patent Application No. 05-202270, and the following composition was used as the fixer at 35° C.:

<Composition of Fixer>

| | |
|---|---|
| Sodium thiosulfate | 185 g |
| Disodium ethylenediaminetetraacetate dihydrate | 0.025 g |

-continued

| | |
|---|---|
| Sodium metabisulfite | 22 g |
| Water to make | 1 liter |

The pH thereof was adjusted to 5.5 with sodium hydroxide.

10. Measurement of Absorbance:

<Measurement of Absorbance of Emulsion Layer>

The dye layer-free samples of the photographic materials set forth in Table 1 were each placed in the cell position of a spectrophotometer Model U-3410 (made by Hitachi Ltd.) so that the photosensitive emulsion side might face the light source, and the support was used as reference in order to subtract the absorbance thereof. Under this condition, the absorbance of each sample at 780 nm was measured. Therein, the light transmitted by each photographic material was caught by an integrating sphere disposed about 12 cm ahead and focused on the light sensor part. The total absorbance of the layers other than the emulsion layer was confirmed to be approximately zero by the absorbance measurement of the emulsion layer-free sample.

<Measurement of Total Absorbance of Dye Layer and Emulsion Layer>

With respect to the dye layer-containing samples of the photographic materials set forth in Table 1, the values of their absorbance were each measured in the same manner as described above. Since the absorbance of the emulsion layer part of each sample could be easily inferred from the absorbance of the dye layer-free sample which was comparable therewith, the absorbance data of the dye layer-free samples were adopted as the absorbance values of their corresponding emulsion layer parts.

11. Evaluation of Fixability and Maximum Optical Density (Dmax):

<Evaluation of Fixability>

Photographic Material Nos. 1 to 12 were each dipped in the same fixer as used in the experiment for the observation of interference fringe, and the time at which the fixation of an emulsion was completed to render the emulsion transparent was measured with an Hitachi Spectrophotometer (Model U-3210), thereby evaluating the fixability.

According to this evaluation method, it is desirable that the fixation time be not longer than 5.5 seconds.

<Evaluation of Maximum Optical Density (Dmax)>

Each of Photographic Material Nos. 1 to 12 was exposed to white light, and processed for an ample time with the same developer and fixer as used in the experiment for the observation of interference fringe, and then the optical density thereof was measured. The silver content in each of the thus processed photographic materials was ascertained to remain unchanged by the comparison with that of the unprocessed one.

To the photographic material for laser scan use, it is appropriate to have Dmax of at least 3.0.

12. Relationships of Absorbance of Emulsion Layer to Interference Fringe Level, Dmax and Fixability:

The results obtained by the foregoing measurements of each photographic material are shown in Table 2.

TABLE 2

| Photographic Material No. | Absorbance of Photosensitive Emulsion Layer | Absorbance of Emulsion Side | Dmax | Fixability (sec.) | Interference Fringe Level |
|---|---|---|---|---|---|
| 1 | 0.10 | 0.10 | 3.7 | 4.9 | 5 |
| 2 | 0.26 | 0.26 | 3.2 | 5.1 | 5 |
| 3 | 0.44 | 0.44 | 2.8 | 5.4 | 3 |
| 4 | 0.60 | 0.60 | 2.6 | 5.7 | 1 |
| 5 | 1.2 | 1.2 | 1.7 | 6.7 | 1 |
| 6 | 0.46 | 0.46 | 7.4(*) | 8.1 | 3 |
| 7 | 0.54 | 0.54 | 9.3(*) | 9.5 | 1 |
| 8 | 0.26 | 0.60 | 3.2 | 5.1 | 4 |
| 9 | 0.26 | 0.90 | 3.2 | 5.2 | 2 |
| 10 | 0.26 | 1.1 | 3.2 | 5.1 | 1 |
| 11 | 0.10 | 1.2 | 3.7 | 4.8 | 1 |
| 12 | 0.26 | 2.2(**) | 3.2 | 5.2 | 4 |

(*) values calculated from covering power.
(**) value including the absorbance of the dye in the backing layer.

It can be seen from Table 2 that each of the photographic materials which not only had Dmax in the permissible range but also exhibited excellent fixability had the emulsion layer whose absorbance was not greater than 0.5, and further that the photographic materials whose emulsion layers had their individual absorbance values in the foregoing range suffered the generation of interference fringe. Moreover, it has proved that although the interference fringe was hardly dissolved by providing such a photographic material with the dye layer on the back side, and that by raising the total absorbance up to greater than 1, the complete dissolution thereof was realized by providing such photographic materials with the dye layer on the emulsion layer side, and that by raising their individual total absorbance values up to greater than 1.

While the invention has been described in detail and with reference to specific embodiments thereof, it will be apparent to one skilled in the art that various changes and modifications can be made therein without departing from the spirit and scope thereof.

What is claimed is:

1. A photographic material which is capable of being exposed using near infrared laser light and which comprises: (i) a transparent support, (ii) a near infrared-sensitive emulsion layer provided on one side of the transparent support, and (iii) a hydrophilic colloid layer provided on the same side of the transparent support as the near infrared-sensitive emulsion layer, wherein the near infrared-sensitive emulsion layer has an absorbance of not more than 0.5 at the wavelength of the near infrared laser light used for exposure;

the near-infrared sensitive emulsion layer and the hydrophilic colloid layer have an absorbance of not less than 1.0 at the wavelength of the near-infrared laser light used for exposure; and the hydrophilic colloid layer comprises at least one solid fine particle dispersion dye represented by Formula (I):

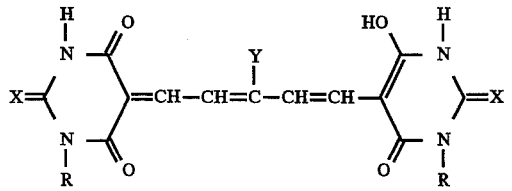

(I)

wherein R represents an aryl group; X represents an oxygen atom or a sulfur atom; and Y represents an alkyl group having 1 to 4 carbon atoms;. provided that neither R nor Y contains a group having an ionizable proton or salt thereof.

2. The photographic material as claimed in claim 2, wherein the hydrophilic colloid layer is disposed between the near-infrared sensitive emulsion layer and the transparent support.

3. The photographic material as claimed in claim 1, wherein the solid fine particle dispersion dye absorbs a near-infrared laser light having a wavelength of 700 nm or more.

* * * * *